US008299984B2

(12) United States Patent
Nathan et al.

(10) Patent No.: US 8,299,984 B2
(45) Date of Patent: Oct. 30, 2012

(54) PIXEL CIRCUIT, DISPLAY SYSTEM AND DRIVING METHOD THEREOF

(75) Inventors: Arokia Nathan, Cambridge (GB); G. Reza Chaji, Waterloo (CA); J. Marcel Dionne, Waterloo (CA)

(73) Assignee: Ignis Innovation Inc., Waterloo, Ontario (CA)

( * ) Notice: Subject to any disclaimer, the term of this patent is extended or adjusted under 35 U.S.C. 154(b) by 766 days.

(21) Appl. No.: 12/424,185

(22) Filed: Apr. 15, 2009

(65) Prior Publication Data

US 2009/0262101 A1 Oct. 22, 2009

(30) Foreign Application Priority Data

Apr. 16, 2008 (CA) ..... 2631683

(51) Int. Cl.
*G09G 3/30* (2006.01)

(52) U.S. Cl. ..... 345/76; 315/169.3

(58) Field of Classification Search ..... 345/76–82, 345/45; 315/169.3

See application file for complete search history.

(56) References Cited

U.S. PATENT DOCUMENTS 6,594,606 B2 7/2003 Everitt
6,618,030 B2 9/2003 Kane et al.

(Continued)

FOREIGN PATENT DOCUMENTS

CA 2109951 11/1992

(Continued)

OTHER PUBLICATIONS

Extended European Search Report mailed Apr. 27, 2011 issued during prosecution of corresponding European patent application No. 09733076.5 (13 pages).

(Continued)

*Primary Examiner* — Amare Mengistu
*Assistant Examiner* — Dmitriy Bolotin
(74) *Attorney, Agent, or Firm* — Nixon Peabody LLP

(57) ABSTRACT

A display system and method for the same is provided. A display includes a plurality of pixels, each having a light emitting device and a driving transistor for driving the light emitting device, the driving transistor and the light emitting device being coupled in series between a first power supply and a second power supply. The method includes: at a first frame, programming a pixel with a first programming voltage different from a programming voltage for a valid image, and charging at least one of the first power supply and the second power supply so that at least one of the driving transistor and the light emitting device is under a negative bias. The pixel circuit includes: a light emitting device; a driving transistor for driving the light emitting device, the driving transistor having a gate terminal, a first terminal coupled to the light emitting device, and a second terminal; a storage capacitor; a first switch transistor coupled to a data line for providing a programming data and the gate terminal of the driving transistor; and a second switch transistor for reducing a threshold voltage shift of the driving transistor, the storage capacitor and the second switch transistor being coupled in parallel to the gate terminal of the driving transistor and the first terminal of the driving transistor. The method includes: at a first cycle, implementing an image display operation having programming the pixel circuit for a valid image and driving the light emitting device; and at a second cycle, implementing a relaxation operation for reducing a stress on the pixel circuit, including: selecting a relaxation switch transistor coupled to the storage capacitor in parallel.

23 Claims, 8 Drawing Sheets

U.S. PATENT DOCUMENTS

| | | | | |
|---|---|---|---|---|
| 6,677,713 | B1 | 1/2004 | Sung | |
| 6,687,266 | B1 | 2/2004 | Ma et al. | |
| 7,023,408 | B2 | 4/2006 | Chen et al. | |
| 7,116,058 | B2 | 10/2006 | Lo et al. | |
| 7,193,589 | B2 * | 3/2007 | Yoshida et al. | 345/76 |
| 7,355,574 | B1 | 4/2008 | Leon et al. | |
| 7,868,859 | B2 * | 1/2011 | Tomida et al. | 345/82 |
| 7,969,390 | B2 * | 6/2011 | Yoshida | 345/76 |
| 2003/0076048 | A1 | 4/2003 | Rutherford | |
| 2003/0197663 | A1 * | 10/2003 | Lee et al. | 345/76 |
| 2004/0070557 | A1 | 4/2004 | Asano et al. | |
| 2004/0183759 | A1 | 9/2004 | Stevenson et al. | |
| 2005/0007357 | A1 * | 1/2005 | Yamashita et al. | 345/204 |
| 2005/0067970 | A1 | 3/2005 | Libsch et al. | |
| 2005/0206590 | A1 | 9/2005 | Sasaki et al. | |
| 2005/0269959 | A1 | 12/2005 | Uchino et al. | |
| 2005/0285822 | A1 * | 12/2005 | Reddy et al. | 345/76 |
| 2006/0092185 | A1 | 5/2006 | Jo et al. | 345/690 |
| 2006/0273997 | A1 | 12/2006 | Nathan et al. | |
| 2007/0001937 | A1 | 1/2007 | Park et al. | |
| 2007/0008268 | A1 | 1/2007 | Park et al. | |
| 2007/0069998 | A1 * | 3/2007 | Naugler et al. | 345/81 |
| 2007/0103419 | A1 | 5/2007 | Uchino et al. | |
| 2007/0273294 | A1 * | 11/2007 | Nagayama | 315/169.3 |
| 2007/0285359 | A1 | 12/2007 | Ono | |
| 2007/0296672 | A1 | 12/2007 | Kim et al. | |
| 2008/0042948 | A1 | 2/2008 | Yamashita et al. | |
| 2008/0074413 | A1 | 3/2008 | Ogura | |
| 2008/0088549 | A1 * | 4/2008 | Nathan et al. | 345/80 |
| 2009/0160743 | A1 * | 6/2009 | Tomida et al. | 345/80 |

FOREIGN PATENT DOCUMENTS

| | | | |
|---|---|---|---|
| CA | 2498136 | | 3/2004 |
| CA | 2526782 | | 4/2006 |
| EP | 1418566 | | 5/2004 |
| WO | 03/034389 | A | 4/2003 |
| WO | 2006/063448 | A | 6/2006 |
| WO | 2007/003877 | A | 1/2007 |
| WO | WO 2007079572 | A1 * | 7/2007 |

OTHER PUBLICATIONS

Alexander et al.: "Pixel circuits and drive schemes for glass and elastic AMOLED displays"; dated Jul. 2005 (9 pages).

Ashtiani et al.: "AMOLED Pixel Circuit With Electronic Compensation of Luminance Degradation"; dated Mar. 2007 (4 pages).

Chahi et al.: "An Enhanced and Simplified Optical Feedback Pixel Circuit for AMOLED Displays"; dated Oct. 2006.

Chaji et al.: "A Current-Mode Comparator for Digital Calibration of Amorphous Silicon AMOLED Displays"; dated Jul. 2008 (5 pages).

Chaji et al.: "A Low-Cost Stable Amorphous Silicon AMOLED Display with Full V~T- and V~O~L~E~D Shift Compensation"; dated May 2007 (4 pages).

Chaji et al.: "A low-power driving scheme for a-Si:H active-matrix organic light-emitting diode displays"; dated Jun. 2005 (4 pages).

Chaji et al.: "A low-power high-performance digital circuit for deep submicron technologies"; dated Jun. 2005 (4 pages).

Chaji et al.: "A novel a-Si:H AMOLED pixel circuit based on short-term stress stability of a-Si:H TFTs"; dated Oct. 2005 (3 pages).

Chaji et al.: "A Novel Driving Scheme and Pixel Circuit for AMOLED Displays"; dated Jun. 2006 (4 pages).

Chaji et al.: "A novel driving scheme for high-resolution large-area a-Si:H AMOLED displays"; dated Aug. 2005 (4 pages).

Chaji et al.: "A Stable Voltage-Programmed Pixel Circuit for a-Si:H AMOLED Displays"; dated Dec. 2006 (12 pages).

Chaji et al.: "A Sub-μA fast-settling current-programmed pixel circuit for AMOLED displays"; dated Sep. 2007.

Chaji et al.: "Compensation technique for DC and transient instability of thin film transistor circuits for large-area devices"; dated Aug. 2008.

Chaji et al.: "Driving scheme for stable operation of 2-TFT a-Si AMOLED pixel"; dated Apr. 2005 (2 pages).

Chaji et al.: "Dynamic-effect compensating technique for stable a-Si:H AMOLED displays"; dated Aug. 2005 (4 pages).

Chaji et al.: "Electrical Compensation of OLED Luminance Degradation"; dated Dec. 2007 (3 pages).

Chaji et al.: "eUTDSP: a design study of a new VLIW-based DSP architecture"; dated May 2003 (4 pages).

Chaji et al.: "Fast and Offset-Leakage Insensitive Current-Mode Line Driver for Active Matrix Displays and Sensors"; dated Feb. 2009 (8 pages).

Chaji et al.: "High Speed Low Power Adder Design With a New Logic Style: Pseudo Dynamic Logic (SDL)"; dated Oct. 2001 (4 pages).

Chaji et al.: "High-precision, fast current source for large-area current-programmed a-Si flat panels"; dated Sep. 2006 (4 pages).

Chaji et al.: "Low-Cost AMOLED Television with IGNIS Compensating Technology"; dated May 2008 (4 pages).

Chaji et al.: "Low-Cost Stable a-Si:H AMOLED Display for Portable Applications"; dated Jun. 2006 (4 pages).

Chaji et al.: "Low-Power Low-Cost Voltage-Programmed a-Si:H AMOLED Display"; dated Jun. 2008 (5 pages).

Chaji et al.: "Merged phototransistor pixel with enhanced near infrared response and flicker noise reduction for biomolecular imaging"; dated Nov. 2008 (3 pages).

Chaji et al.: "Parallel Addressing Scheme for Voltage-Programmed Active-Matrix OLED Displays"; dated May 2007 (6 pages).

Chaji et al.: "Pseudo dynamic logic (SDL): a high-speed and low-power dynamic logic family"; dated 2002 (4 pages).

Chaji et al.: "Stable a-Si:H circuits based on short-term stress stability of amorphous silicon thin film transistors"; dated May 2006 (4 pages).

Chaji et al.: "Stable Pixel Circuit for Small-Area High-Resolution a-Si:H AMOLED Displays"; dated Oct. 2008 (6 pages).

Chaji et al.: "Thin-Film Transistor Integration for Biomedical Imaging and AMOLED Displays"; dated 2008 (177 pages).

Jafarabadiashtiani et al.: "A New Driving Method for a-Si AMOLED Displays Based on Voltage Feedback"; dated 2005 (4 pages).

Lee et al.: "Ambipolar Thin-Film Transistors Fabricated by PECVD Nanocrystalline Silicon"; dated 2006 (6 pages).

Matsueda y et al.: "35.1: 2.5-in. AMOLED with Integrated 6-bit Gamma Compensated Digital Data Driver"; dated May 2004.

Nathan et al.: "Backplane Requirements for Active Matrix Organic Light Emitting Diode Displays"; dated 2006 (16 pages).

Nathan et al.: "Driving schemes for a-Si and LTPS AMOLED displays"; dated Dec. 2005 (11 pages).

Nathan et al.: "Invited Paper: a -Si for AMOLED—Meeting the Performance and Cost Demands of Display Applications (Cell Phone to HDTV)"; dated 2006 (4 pages).

Philipp: "Charge transfer sensing" Sensor Review, vol. 19, No. 2, Dec. 31, 1999, 10 pages.

Rafati et al.: "Comparison of a 17 b multiplier in Dual-rail domino and in Dual-rail D L (D L) logic styles"; dated 2002 (4 pages).

Safavaian et al.: "Three-TFT image sensor for real-time digital X-ray imaging"; dated Feb. 2, 2006 (2 pages).

Safavian et al.: "3-TFT active pixel sensor with correlated double sampling readout circuit for real-time medical x-ray imaging"; dated Jun. 2006 (4 pages).

Safavian et al.: "A novel current scaling active pixel sensor with correlated double sampling readout circuit for real time medical x-ray imaging"; dated May 2007 (7 pages).

Safavian et al.: "A novel hybrid active-passive pixel with correlated double sampling CMOS readout circuit for medical x-ray imaging"; dated May 2008 (4 pages).

Safavian et al.: "Self-compensated a-Si:H detector with current-mode readout circuit for digital X-ray fluoroscopy"; dated Aug. 2005 (4 pages).

Safavian et al.: "TFT active image sensor with current-mode readout circuit for digital x-ray fluoroscopy [5969D-82]"; dated Sep. 2005 (9 pages).

Vygranenko et al.: "Stability of indium-oxide thin-film transistors by reactive ion beam assisted deposition"; dated 2009.

Wang et al.: "Indium oxides by reactive ion beam assisted evaporation: From material study to device application"; dated Mar. 2009 (6 pages).
Yi He et al., "Current-Source a-Si:II Thin Film Transistor Circuit for Active-Matrix Organic Light-Emitting Displays", IEEE Electron Device Letters, vol. 21, No. 12, Dec. 2000, pp. 590-592.
International Search Report mailed Jul. 30, 2009 for International Application No. PCT/CA2009/000501 (4 pages).
Written Opinion mailed Jul. 30, 2009 for International Application No. PCT/CA2009/000501 (6 pages).

* cited by examiner

PIXEL CIRCUIT, DISPLAY SYSTEM AND DRIVING METHOD THEREOF

FIELD OF INVENTION

The present invention relates to display devices, and more specifically to a pixel circuit, a light emitting device display and an operation technique for the light emitting device display.

BACKGROUND OF THE INVENTION

Electro-luminance displays have been developed for a wide variety of devices, such as, personal digital assistants (PDAs) and cell phones. In particular, active-matrix organic light emitting diode (AMOLED) displays with amorphous silicon (a-Si), poly-silicon, organic, or other driving backplane have become more attractive due to advantages, such as feasible flexible displays, its low cost fabrication, high resolution, and a wide viewing angle.

An AMOLED display includes an array of rows and columns of pixels, each having an organic light emitting diode (OLED) and backplane electronics arranged in the array of rows and columns. Since the OLED is a current driven device, there is a need to provide an accurate and constant drive current.

However, the AMOLED displays exhibit non-uniformities in luminance on a pixel-to-pixel basis, as a result of pixel degradation. Such degradation includes, for example, aging caused by operational usage over time (e.g., threshold shift, OLED aging). Depending on the usage of the display, different pixels may have different amounts of the degradation. There may be an ever-increasing error between the required brightness of some pixels as specified by luminance data and the actual brightness of the pixels. The result is that the desired image will not show properly on the display.

Therefore, there is a need to provide a method and system that is capable of recovering displays.

SUMMARY OF THE INVENTION

It is an object of the invention to provide a method and system that obviates or mitigates at least one of the disadvantages of existing systems.

According to an aspect of the present invention there is provided a method of recovering a display having a plurality of pixels, each having a light emitting device and a driving transistor for driving the light emitting device, the driving transistor and the light emitting device being coupled in series between a first power supply and a second power supply. The method includes: at a first frame, programming a pixel with a first programming voltage different from an image programming voltage for a valid image, and charging at least one of the first power supply and the second power supply so that at least one of the driving transistor and the light emitting device is under a negative bias.

According to another aspect of the present invention there is provided a pixel circuit that includes: a light emitting device; a driving transistor for driving the light emitting device, the driving transistor having a gate terminal, a first terminal coupled to the light emitting device, and a second terminal; a storage capacitor; a first switch transistor coupled to a data line for providing a programming data and the gate terminal of the driving transistor; and a second switch transistor for reducing a threshold voltage shift of the driving transistor, the storage capacitor and the second switch transistor being coupled in parallel to the gate terminal of the driving transistor and the first terminal of the driving transistor.

According to a further aspect of the present invention there is provided a method for a display having a pixel circuit. The pixel circuit has a light emitting device, a driving transistor for driving the light emitting device, and a storage capacitor. The method includes: at a first cycle, implementing an image display operation having programming the pixel circuit for a valid image and driving the light emitting device; and at a second cycle, implementing a relaxation operation for reducing a stress on the pixel circuit, including: selecting a relaxation switch transistor coupled to the storage capacitor in parallel, the storage capacitor being coupled to the gate terminal of the driving transistor and a first terminal of the driving transistor.

BRIEF DESCRIPTION OF THE DRAWINGS

These and other features of the invention will become more apparent from the following description in which reference is made to the appended drawings wherein.

DETAILED DESCRIPTION

Embodiments of the present invention are described using an active matrix light emitting display and a pixel that has an organic light emitting diode (OLED) and one or more thin film transistors (TFTs). However, the pixel may include a light emitting device other than OLED, and the pixel may include transistors other than TFTs. The transistors of the pixel and display elements may be fabricated using poly silicon, nano/micro crystalline silicon, amorphous silicon, organic semiconductors technologies (e.g. organic TFTs), NMOS technology, CMOS technology (e.g. MOSFET), metal oxide technologies, or combinations thereof.

In the description, "pixel circuit" and "pixel" are used interchangeably. In the description, "signal" and "line" may be used interchangeably. In the description, "connect (or connected)" and "couple (or coupled)" may be used interchangeably, and may be used to indicate that two or more elements are directly or indirectly in physical or electrical contact with each other.

In the embodiments, each transistor has a gate terminal, a first terminal and a second terminal where the first terminal (the second terminal) may be, but not limited to, a drain terminal or a source terminal (source terminal or drain terminal).

Figure 1:
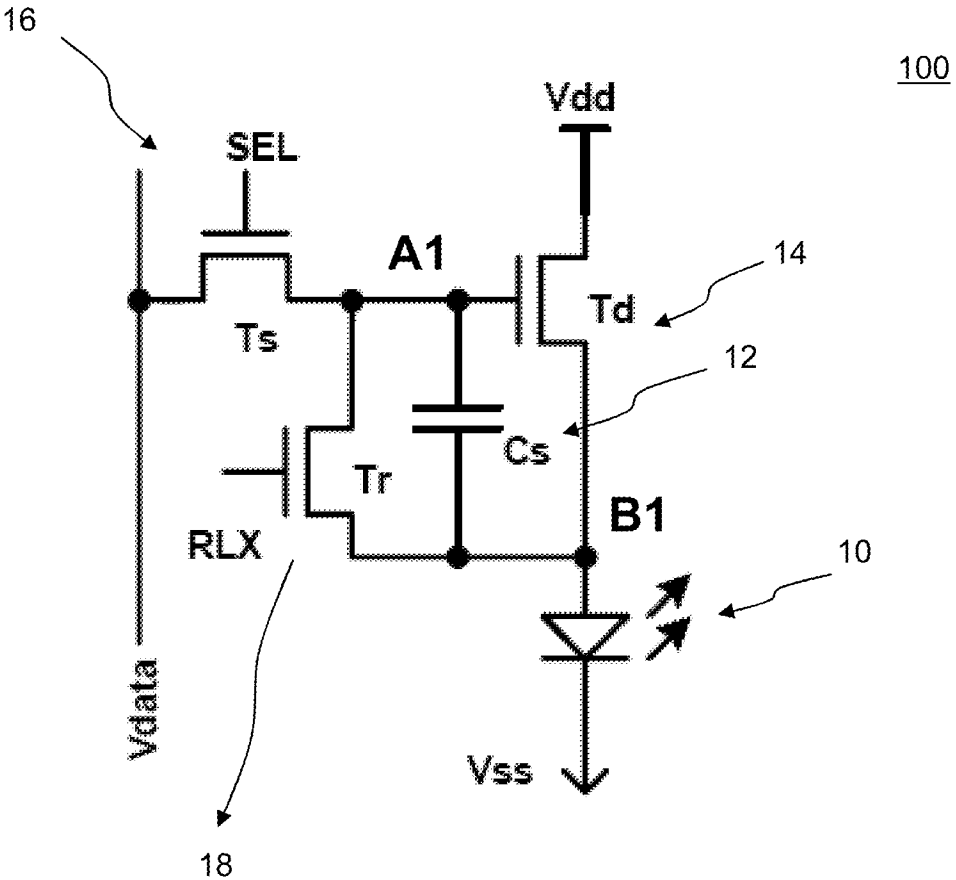
FIG. 1 is a diagram showing an example of a pixel circuit in accordance with an embodiment of the present invention.

A relaxation driving scheme for recovering pixel components is now described in detail. FIG. 1 illustrates an example of a pixel circuit in accordance with an embodiment of the present invention. The pixel circuit 100 of FIG. 1 employs a relaxation driving scheme for recovering the aging of the pixel elements. The pixel circuit 100 includes an OLED 10, a storage capacitor 12, a driving transistor 14, a switch transistor 16, and a relaxation circuit 18. The storage capacitor 12 and the transistors 14 and 16 form a pixel driver for driving the OLED 10. In FIG. 1, the relaxation circuit 18 is implemented by a transistor 18, hereinafter referred to as transistor 18 or relaxation (switch) transistor 18. In FIG. 1, the transistors 14, 16, and 18 are n-type TFTs.

An address (select) line SEL, a data line Vdata for providing a programming data (voltage) Vdata to the pixel circuit, power supply lines Vdd and Vss, and a relaxation select line RLX for the relaxation are coupled to the pixel circuit 100. Vdd and Vss may be controllable (changeable).

The first terminal of the driving transistor 14 is coupled to the voltage supply line Vdd. The second terminal of the driving transistor 14 is coupled to the anode electrode of the OLED 10 at node B1. The first terminal of the switch transistor 16 is coupled to the data line Vdata. The second terminal of the switch transistor 16 is coupled to the gate terminal of the driving transistor at node A1. The gate terminal of the switch transistor 16 is coupled to the select line SEL. The storage capacitor is coupled to node A1 and node B1. The relaxation switch transistor 18 is coupled to node A1 and node B1. The gate terminal of the relaxation switch transistor 18 is coupled to RLX.

In a normal operation mode (active mode), the pixel circuit 100 is programmed with the programming data (programming state), and then a current is supplied to the OLED 10 (light emission/driving state). In the normal operation mode, the relaxation switch transistor 18 is off. In a relaxation mode, the relaxation switch transistor 18 is on so that the gate-source voltage of the driving transistor 16 is reduced.

Figure 2:
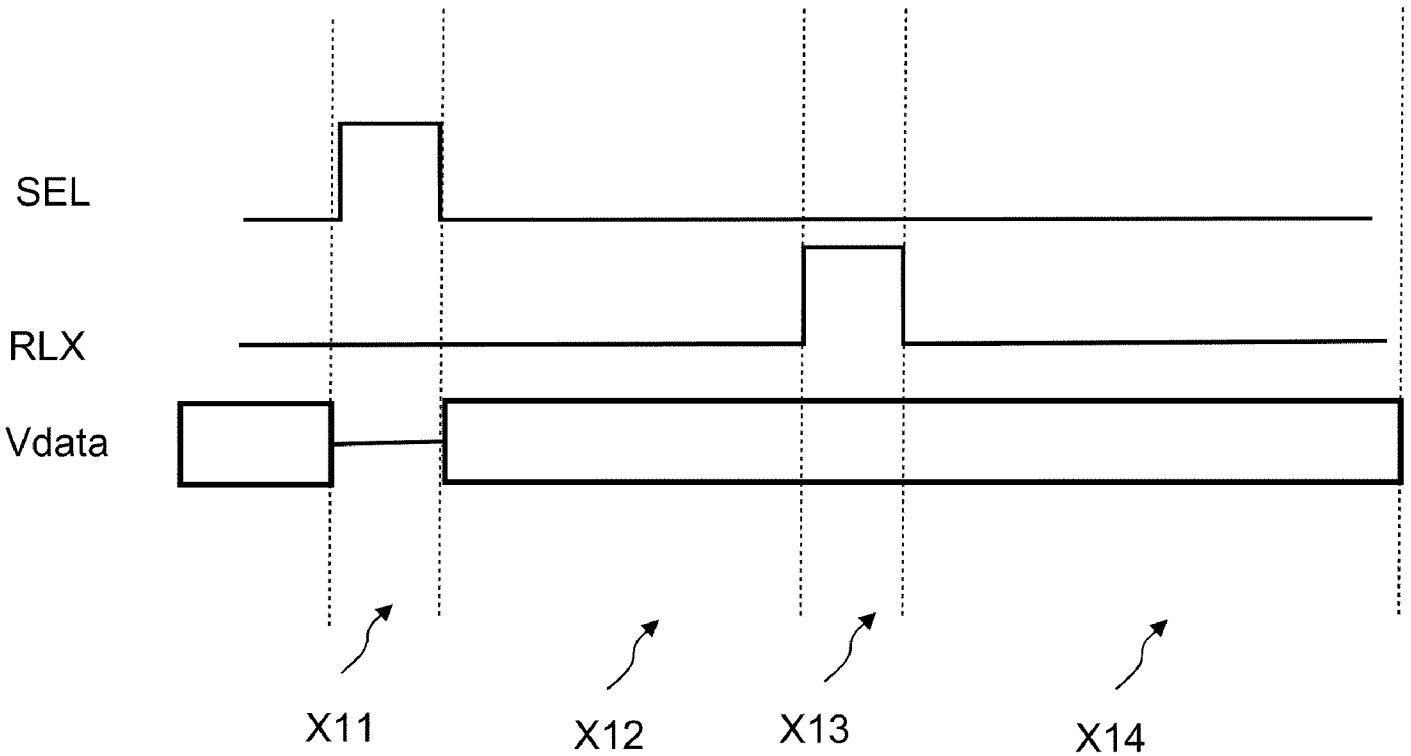
FIG. 2 is a timing diagram showing exemplary waveforms applied to the pixel circuit of FIG. 1.

FIG. 2 illustrates a driving scheme for the pixel circuit 100 of FIG. 1. The operation for the pixel circuit 100 of FIG. 1 includes four operation cycles X11, X12, X13 and X14. X11, X12, X13 and X14 may form a frame. Referring to FIGS. 1-2, during the first operation cycle X11 (programming cycle), SEL signal is high and the pixel circuit 100 is programmed for a wanted brightness with Vdata. During the second operation cycle X12 (driving cycle), the driving transistor 12 provides current to the OLED 10. During the third operation cycle X13, RLX signal is high and the gate-source voltage of the driving transistor 14 becomes zero. As a result, the driving transistor 14 is not under stress during the fourth operating cycle X14. Thus the aging of the driving transistor 14 is suppressed.

Figure 3:
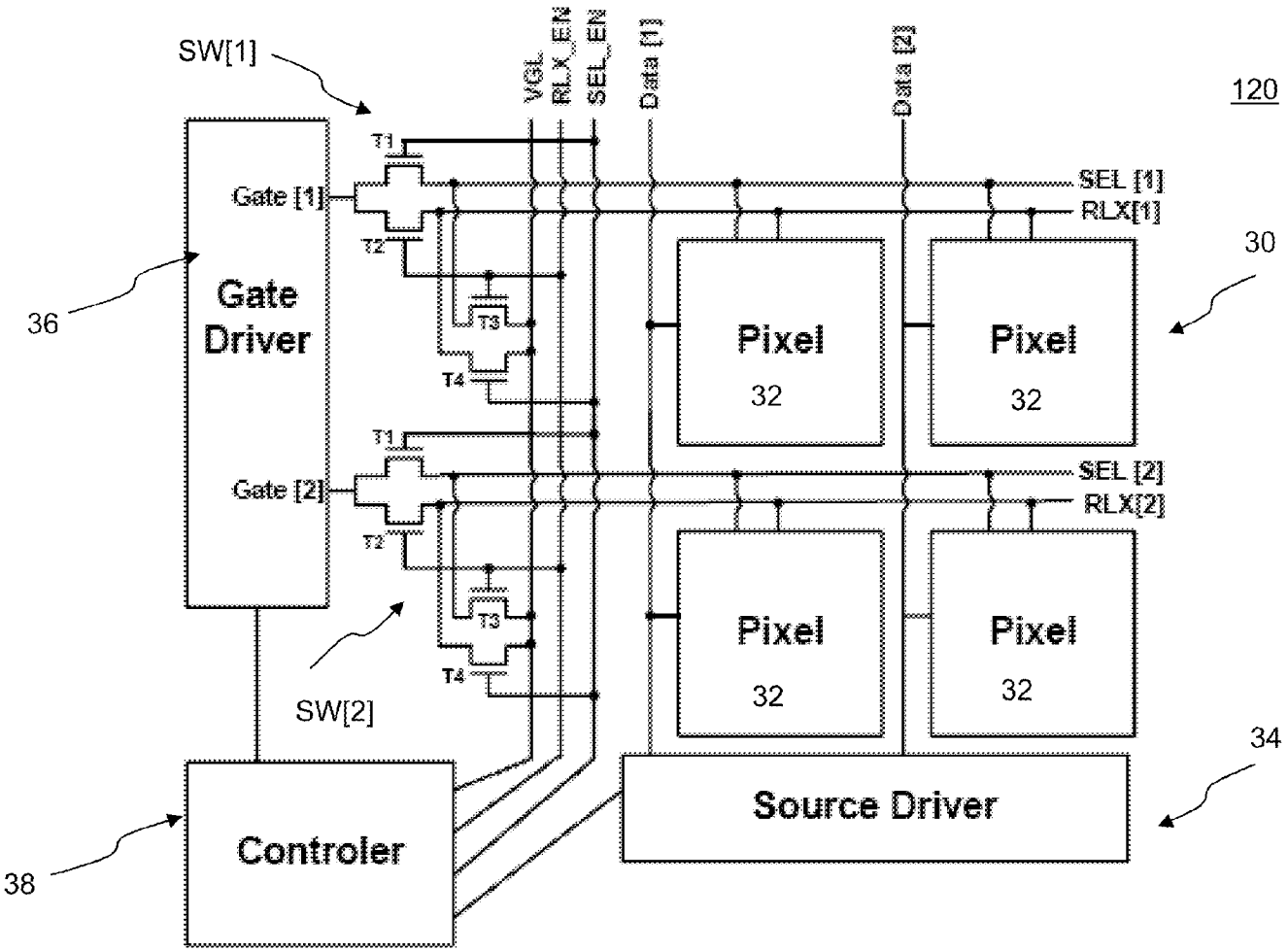
FIG. 3 is a diagram showing an example of a display system having a mechanism for a relaxation driving scheme, in accordance with an embodiment of the present invention.

FIG. 3 illustrates an example of a display system having a mechanism for a relaxation driving scheme, in accordance with an embodiment of the present invention. The display system 120 includes a display array 30. The display array 30 is an AMOLED display where a plurality of pixel circuits 32 are arranged in rows and columns. The pixel circuit 32 may be the pixel circuit 100 of FIG. 1. In FIG. 3, four pixel circuits 32 are arranged with 2 rows and 2 columns. However, the number of the pixel circuits 32 is not limited to four and may vary.

In FIG. 3, SEL[i] represents an address (select) line for the ith row (i=1, 2, . . . ), which is shared among the pixels in the ith row. In FIG. 3, RLX[i] represents a relaxation (select) line for the ith row, which is shared among the pixels in the ith row. In FIG. 3, Datab[j] represents a data line for the jth column (j=1, 2, . . . ), which is shared among the pixels in the jth column. SEL[i] corresponds to SEL of FIG. 1. RLX[i] corresponds to RLX of FIG. 1. Data[j] corresponds to Vdata of FIG. 1.

Data[j] is driven by a source driver 34. SEL[i] and RLX[i] are driven by a gate driver 36. The gate driver 36 provides a gate (select) signal Gate[i] for the ith row. SEL[i] and RLX[i] share the select signal Gate[i] output from the gate driver 36 via a switch circuit SW[i] for the ith row.

The switch circuit SW[i] is provided to control a voltage level of each SEL[i] and RLX[i]. The switch circuit SW[i] includes switch transistors T1, T2, T3, and T4. Enable lines SEL_EN and RLX_EN and a bias voltage line VGL are coupled to the switch circuit SW[i]. In the description, "enable signal SEL_EN" and "enable line SEL_EN" are used interchangeably. In the description, "enable signal RLX_EN" and "enable line RLX_EN" are used interchangeably. A controller 38 controls the operations of the source driver 34, the gate driver 36, SEL_EN, RLX_EN and VGL.

The switch transistor T1 is coupled to a gate driver's output (e.g., Gate[1], Gate [2]) and the select line (e.g., SEL[1], SEL[2]). The switch transistor T2 is coupled to the gate driver's output (e.g., Gate[1], Gate [2]) and the relaxation select line (e.g., RLX[1], RLX[2]). The switch transistor T3 is coupled to the select line (e.g., SEL[1], SEL[2]) and VGL. The switch transistor T4 is coupled to the relaxation select line (e.g., RLX[1], RLX[2]) and VGL. VGL line provides the off voltage of the gate driver 36. VGL is selected so that the switches are Off.

The gate terminal of the switch transistor T1 is coupled to the enable line SEL_EN. The gate terminal of the switch transistor T2 is coupled to the enable line RLX_EN. The gate terminal of the switch transistor T3 is coupled to the enable line RLX_EN. The gate terminal of the switch transistor T4 is coupled to the enable line SEL_EN.

The display system employs a recovery operation including the relaxation operation for recovering the display after being under stress and thus reducing the temporal non-uniformity of the pixel circuits.

Figure 4:
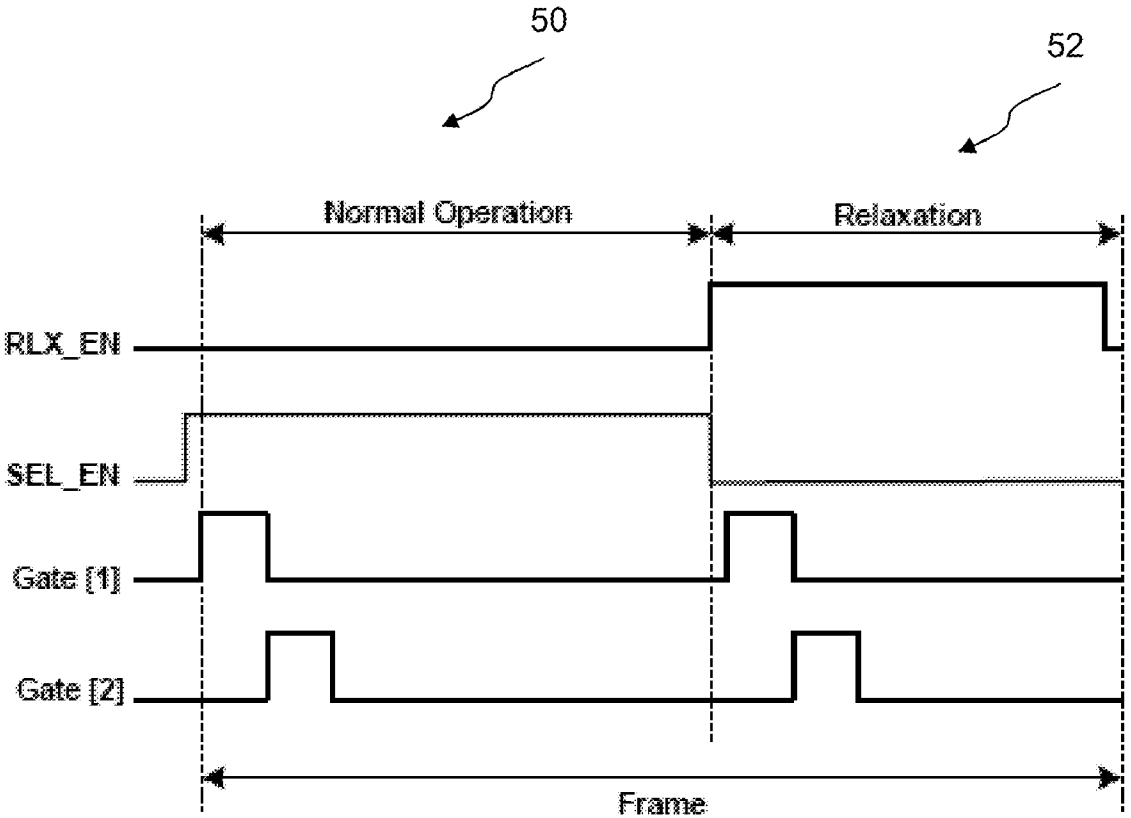
FIG. 4 is a timing diagram showing exemplary waveforms applied to the display system of FIG. 3.

FIG. 4 illustrates a driving scheme for the display system 120 of FIG. 3. Referring to FIGS. 3-4, each frame time operation includes a normal operation cycle 50 and a relaxation cycle 52. The normal operation cycle 50 includes a programming cycle and a driving cycle as well understood by one of ordinary skill in the art. In the normal operation cycle 50, SEL_EN is high so that the switch transistors T1 and T4 are on, and RLX_EN is low so that the switch transistors T2 and T3 are off. In the normal operation cycle 50, SEL [i] (i: the row number, i=1, 2, . . . ) is coupled to the gate driver 36 (Gate[i]) via the switch transistor T1, and RLX[i] is coupled to VGL (the off voltage of the gate driver) via the transistor T4. The gate driver 36 sequentially outputs a select signal for each row (Gate[1], Gate [2]). Based on the select signal and a programming data (e.g., Data [1], Data [2]), the display system 120 programs a selected pixel circuit and drives the OLED in the selected pixel circuit.

In the relaxation cycle 52, SEL_EN is low, and RLX_EN is high. The switch transistors T2 and T3 are on, and the switch transistors T1 and T4 are off. SEL[i] is coupled to VGL via the switch transistor T3, and RLX[i] is coupled to the gate driver 36 (Gate [i]) via the switch transistor T2. As a result, the relaxation switch transistor (e.g., 18 of FIG. 1) is on. The switch transistor coupled to the data line (e.g., 16 of FIG. 1) is off. The gate-source voltage of the driving transistor (e.g., 14 of FIG. 1) in the pixel circuit 32 becomes, for example, zero.

In the above example, the normal operation and the relaxation operation are implemented in one frame. In another example, the relaxation operation may be implemented in a different frame. In a further example, the relaxation operation may be implemented after an active time on which the display system displays a valid image.

A recovery driving scheme for improving pixel component stabilities is now described in detail. The recovery driving scheme uses a recovery operation to improve the display lifetime, including recovering the degradation of pixel components and reducing temporal non-uniformity of pixels. The recovery driving scheme may include the relaxation operation (FIGS. 1-4). The recovery operation may be implemented after a active time or in an active time.

Figure 5:
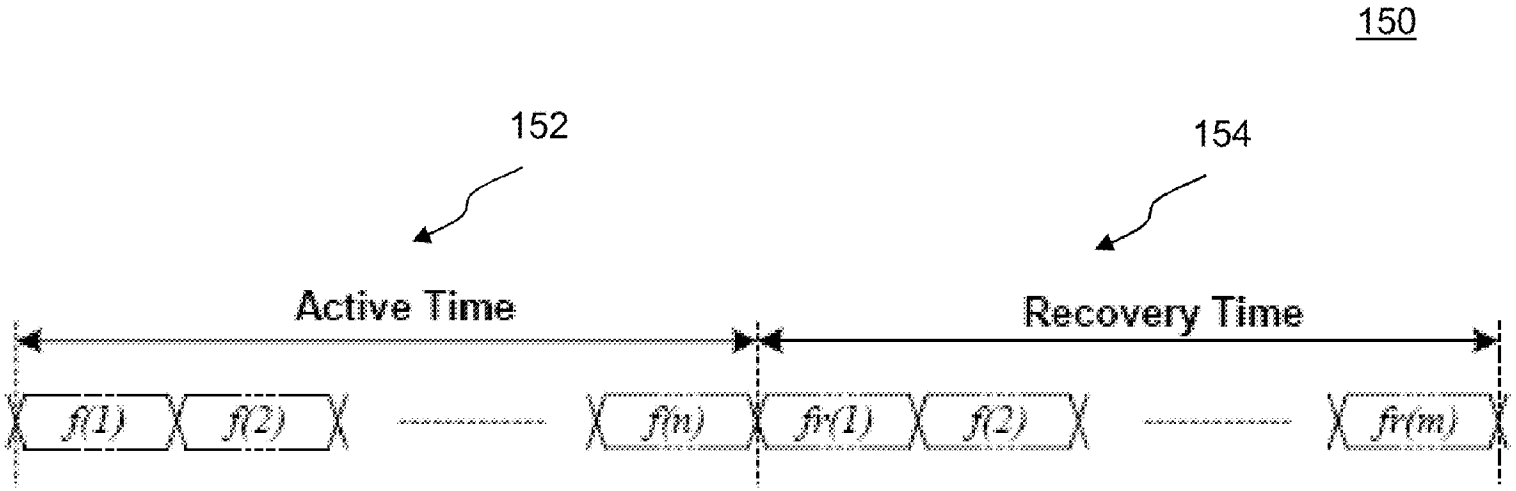
FIG. 5 is a timing diagram showing exemplary frame operations for a recovery driving scheme in accordance with an embodiment of the present invention.

FIG. 5 illustrates a recovery driving scheme for a display system in accordance with an embodiment of the present invention. The recovery driving scheme 150 of FIG. 5 includes an active time 152 and a recovery time 154 after the active time 152. In FIG. 5, "f(k)" (k=1, 2, . . . , n) represents an active frame. In FIG. 5, "fr(1)" (1=1, 2, . . . , m) represents a recovery frame. During the active time 152, the active frames f(1), f(2), . . . , f(n) are applied to a display. During the recovery time 154, the recovery frames fr(1), fr(2), . . . , fr(m) are applied to the display. The recovery driving scheme 150 is applicable to any displays and pixel circuits.

The active time 152 is a normal operation time on which the display system displays a valid image. Each active frame includes a programming cycle for programming a pixel associated with the valid image and a driving cycle for driving a light emitting device. The recovery time 154 is a time for recovering the display and not for showing the valid image.

For example, after a user turns off the display (i.e., turns off a normal image display function or mode), the recovery frames fr(1), . . . , fr(m) are applied to the display to turn over the pixel's components aging. The aging of the pixel elements includes, for example, threshold voltage shift of transistors and OLED luminance and/or electrical degradation. During the recovery frame fr(1), one can operate the display in the relaxation mode (described above) and/or a mode of reducing OLED luminance and electrical degradation.

Figure 6:
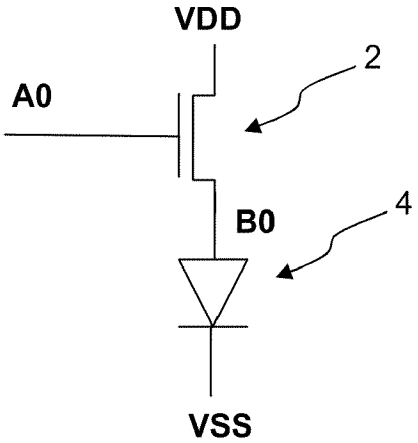
FIG. 6 is a diagram showing an example of pixel components to which the recovery driving scheme of FIG. 5 is applied.

FIG. 6 illustrates one example of pixel components to which the recovery driving scheme of FIG. 5 is applied. As shown in FIG. 6, a pixel circuit includes a driving transistor 2 and OLED 4, being coupled in series between a power supply VDD and a power supply VSS. In FIG. 6. the driving transistor 2 is coupled to the power supply VDD. The OLED 4 is coupled to the driving transistor at node B0 and the power supply line VSS. The gate terminal of the driving transistor 2, i.e., node A0, is charged by a programming voltage. The driving transistor 2 provides a current to the OLED 4.

At least one of VSS and VDD is controllable (changeable). In this example, VSS line is a controllable voltage line so that the voltage on VSS is changeable. VDD line may be a controllable voltage line so that the voltage on VDD is changeable. VSS and VDD lines may be shared by other pixel circuits.

It would be well understood by one of ordinary skill in the art that the pixel circuit may include components other than the driving transistor 2 and the OLED 4, such as a switch transistor for selecting the pixel circuit and providing a programming data on a data line to the pixel circuit, and a storage capacitor in which the programming data is stored.

Figure 7:
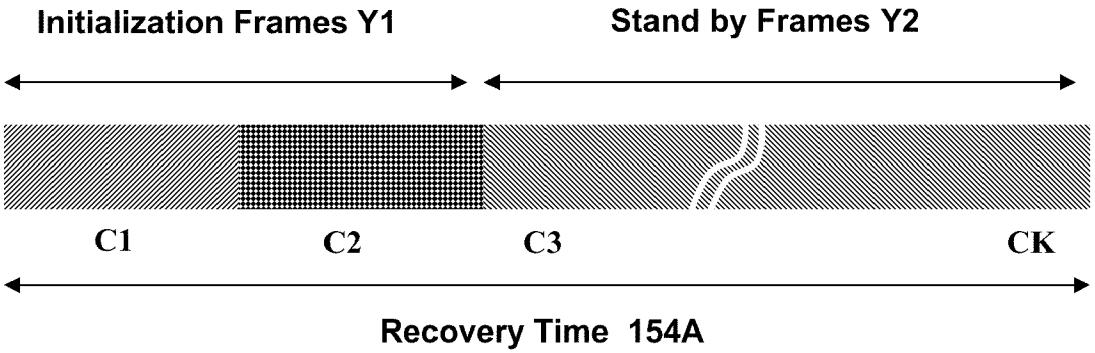
FIG. 7 is a timing diagram showing one example of recovery frames for the recovery driving scheme of FIG. 5.

FIG. 7 illustrates one example of recovery frames associated with the recovery deriving scheme of FIG. 5. The recovery time 154A of FIG. 7 corresponds to the recovery time 154 of FIG. 5, and includes initialization frames Y1 and stand by frames Y2. The initialization frames Y1 include frames C1 and C2. The stand by frames Y2 include frames C3, . . . , CK. The stand by frames Y2 are normal stand by frames.

Referring to FIGS. 6-7, during the first frame C1 in the initialization frames Y1, the display is programmed with a high voltage (VP_R) while VSS is high voltage (VSS_R) and VDD is at VDD_R. As a result, node A0 is charged to VP_R and node B0 is charged to VDD_R. Thus, the voltage at OLED 4 will be—(VSS_R−VDD_R). Considering that VSS_R is larger than VDD_R, the OLED 4 will be under negative bias which will help the OLED 4 to recover.

VSS_R is higher than VSS at a normal image programming and driving operation. VP-R may be higher than that of a general programming voltage VP.

During the second frame C2 in the initialization frames Y1, the display is programmed with gray zero while VDD and VSS preserve their previous value. At this point, the gate-source voltage (VGS) of the driving transistor 2 will be—VDD_R. Thus, the driving transistor 2 will recover from the aging. Moreover, this condition will help to reduce the differential aging among the pixels, by balancing the aging effect. If the state of each pixel is known, one can use different voltages instead of zero for each pixel at this stage. As a result, the negative voltage apply to each pixel will be different so that the recovery will be faster and more efficient.

Each pixel may be programmed with different negative recovery voltage, for example, based on the ageing profile (history of the pixel's aging) or a look up table.

In FIG. 7, the frame C2 is located after the frame C1. However, in another example, the frame C2 may be implemented before the frame C1.

The same technique can be applied to a pixel in which the OLED 4 is coupled to the drain of the driving transistor 2 as well.

Figure 8:
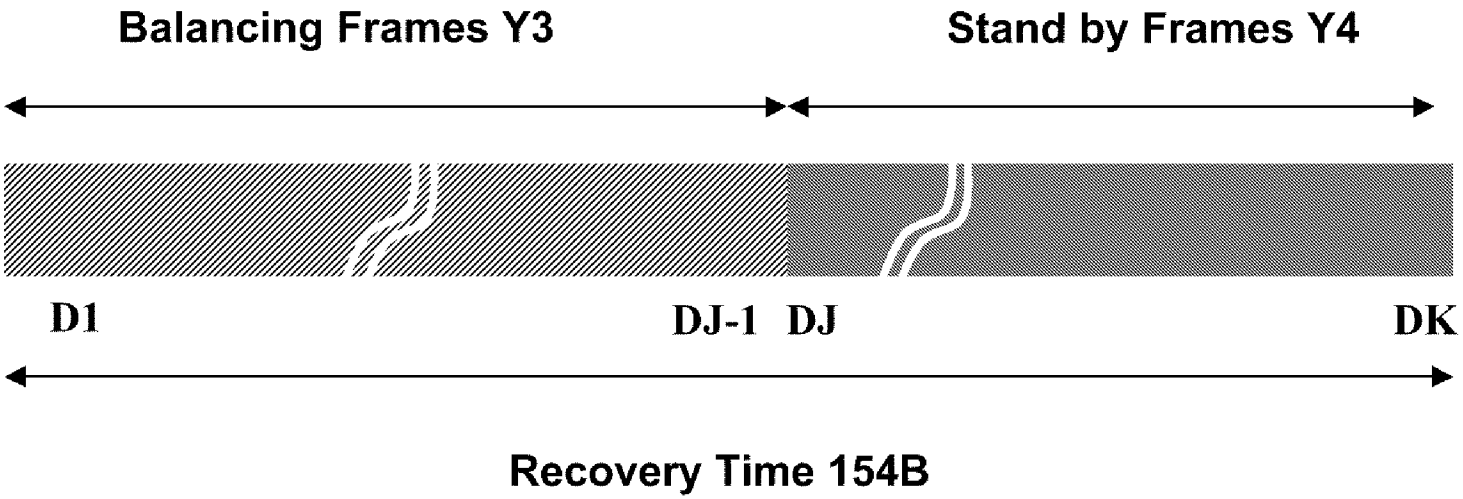
FIG. 8 is a timing diagram showing another example of recovery frames for the recovery driving scheme of FIG. 5.
Figure 9:
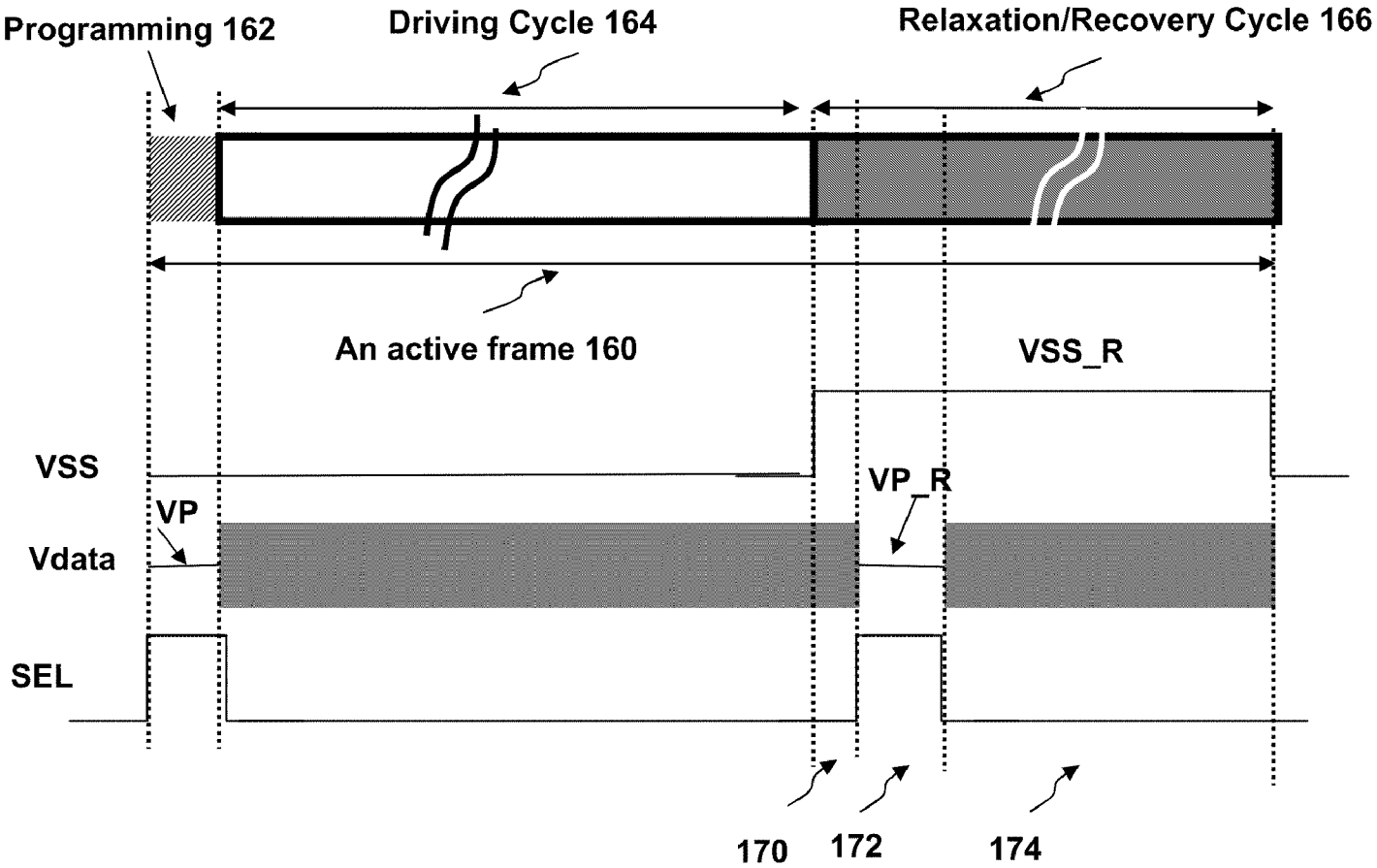
FIG. 9 is a timing diagram showing an example of a driving scheme in accordance with an embodiment of the present invention.

FIG. 8 illustrates another example of recovery frames associated with the recovery deriving scheme of FIG. 5. The recovery time 154B of FIG. 8 corresponds to the recovery time 154 of FIG. 5, and includes balancing frames Y3 and the stand by frames Y4. The stand by frames Y4 include frames DJ, . . . , Dk. The stand by frames Y4 correspond to the stand by frames Y3 of FIG. 7. The balancing frames Y3 include frames D1, . . . , DJ-1.

During the recovery time 154B, the display runs on uncompensated mode for a number of frames D1-DJ-1 that can be selected based on the ON time of the display. In this mode, the part that aged more start recovering and the part that aged less will age. This will balance the display uniformity over time.

In the above example, the display has the recovery time (154 of FIG. 5) after the active time (152 of FIG. 5). However, in another example, an active frame is divided into programming, driving and relaxation/recovery cycles. FIG. 8 illustrates a further example of a driving scheme for a display in accordance with an embodiment of the present invention. The active frame 160 of FIG. 8 includes a programming cycle 162, a driving cycle 164, and a relaxation/recovery cycle 166. In FIG. 8, the active frame 160 is divided into the programming cycle 162, the driving cycle 164, and the relaxation/recovery cycle 166. The driving scheme of FIG. 8 is applied to a pixel having the driving transistor 2 and the OLED 4 of FIG. 6.

Referring to FIGS. 6 and 8, during the programming cycle 162, the pixel is programmed with a required programming voltage VP. During the driving cycle 164, the driving transistor 2 provides current to the OLED 4 based on the programming voltage VP. After the driving cycle 164, the relaxation/recovery cycle 166 starts. During the relaxation/recovery cycle 166, the degradation of pixel components is recovered. In this example, the display system implements a recovery operation formed by a first operation cycle 170, a second operation cycle 172 and a third operation cycle 174.

During the first operation cycle 170, VSS goes to VSS_R, and so node B0 is charged to VP-VT (VT: threshold voltage of the driving transistor 4). During the first operation cycle 172, node A0 is charged to VP_R and so the gate voltage of the driving transistor 2 will be—(VP-VT-VP_R). As a result, the pixel with larger programming voltage during the driving cycle 164 will have a larger negative voltage across its gate-source voltage. This will results in faster recovery for the pixels at higher stress condition.

In another example, the display system may be in the relaxation mode during the relaxation/recovery cycle 166.

In a further example, the history of pixels' aging may be used. If the history of the pixel's aging is known, each pixel can be programmed with different negative recovery voltage according to its aging profile. This will result in faster and more effective recovery. The negative recovery voltage is calculated or fetch from a look up table, based on the aging of the each pixel.

In the above embodiments, the pixel circuits and display systems are described using n-type transistors. However, one of ordinary skill in the art would appreciate that the n-type transistor in the circuits can be replaced with a p-type transistor with complementary circuit concept. One of ordinary skill in the art would appreciate that the programming, driving and relaxation techniques in the embodiments are also applicable to a complementary pixel circuit having p-type transistors.

One or more currently preferred embodiments have been described by way of example. It will be apparent to persons skilled in the art that a number of variations and modifications can be made without departing from the scope of the invention as defined in the claims.

What is claimed is:

1. A method of recovering a display having a plurality of pixels, each having a light emitting device and a driving transistor for driving the light emitting device, the driving transistor and the light emitting device being coupled in series between a first power supply and a second power supply, comprising:

during a first frame, programming a first pixel of the plurality of pixels with a first programming voltage different from an image programming voltage for a valid image, and charging at least one of a voltage at the first power supply and a voltage at the second power supply so that at least one of the driving transistor or the light emitting device is under a reverse bias; and during one or more stand by frames following the first frame, allowing the at least one of the driving transistor or the light emitting device to maintain the reverse bias while the display is turned off so as to recover the display aging.

2. The method as claimed in claim 1, further comprising:

during a second frame after the first frame, programming the first pixel with a second programming voltage without changing voltage levels on the first and second power supplies so that the other one of the driving transistor or the light emitting device is under a reverse bias.

3. The method as claimed in claim 1, further comprising:

programming the first pixel in the plurality of pixels with a recovery voltage so as to reverse bias the driving transistor in the first pixel according to the recovery voltage, the recovery voltage being based on the history of the first pixel's aging.

4. The method as claimed in claim 3, further comprising: programming each pixel in the plurality of pixels with a recovery voltage for each pixel so as to reverse bias the driving transistor in each pixel according to the recovery voltage, wherein the recovery voltage for each pixel is calculated according to the aging profile of each pixel circuit so as to reduce the differential aging of the pixels in the plurality of pixels.

5. The method as claimed in claim 3, further comprising: programming each pixel in the plurality of pixels with a recovery voltage for each pixel so as to reverse bias the driving transistor in each pixel according to the recovery voltage, wherein the recovery voltage for each pixel is retrieved from a lookup table according to the aging profile of each pixel circuit so as to reduce the differential aging of the pixels in the plurality of pixels.

6. The method as claimed in claim 1, wherein the programming with the first programming voltage is implemented during a normal active time, wherein the active time is a normal operation time during which the display displays a valid image during a normal programming and driving cycle such that one frame time includes programming and driving the display to display a valid image and reverse biasing at least one of the driving transistor or the light emitting device.

7. The method as claimed in claim 6, further comprising:

programming each pixel with a programming voltage for a valid image, during a programming cycle;

driving each pixel to emit light via the light emitting device according to the programming voltage, during a driving cycle; and applying a voltage to the driving transistor in each pixel based on the magnitude of the programming voltage, such the driving transistor in each pixel circuit is reverse biased according to the stress condition of the pixel during the driving cycle.

8. The method as claimed in claim 1, further comprising:

during the one or more stand by frames, disconnecting the first and second power supplies from a power converter such that the reverse bias on the at least one of the light emitting device or the driving transistor charged during the first frame is maintained by the line capacitance of the first and second power supplies.

9. The method as claimed in claim 1, wherein the programming the first pixel with the first programming voltage is implemented after a normal programming and driving cycle for the first pixel.

10. A pixel circuit comprising:

a light emitting device;

a driving transistor for driving the light emitting device, the driving transistor having a gate terminal, a first terminal coupled to the light emitting device, and a second terminal, the driving transistor and the light emitting device being coupled in series between a first power supply line and a second power supply line;

a storage capacitor;

a first switch transistor coupled to a data line for providing programming data to the gate terminal of the driving transistor;

a second switch transistor for reducing a threshold voltage shift of the driving transistor, the storage capacitor and the second switch transistor being coupled in parallel to the gate terminal of the driving transistor and the first terminal of the driving transistor; and a controller for operating the first and second switch transistor, the data line, and the first and second power supply lines, such that:

during a first frame, the pixel circuit is programmed with a first programming voltage different from an image programming voltage for a valid image, by applying the first programming voltage to the gate terminal of the driving transistor via the first switch transistor, and at least one of the first and second power supply lines are set so that at least one of the driving transistor or the light emitting device is under a reverse bias; and during one or more stand by frames following the first frame, the at least one of the driving transistor or the light emitting device maintains the reverse bias while the display is turned off so as to recover the display aging.

11. The pixel circuit as claimed in claim 10, wherein the first switch transistor is off and the second switch transistor is on, during a relaxation mode.

12. The pixel circuit as claimed in claim 10, wherein a first select line coupled to the gate terminal of the first switch transistor and a second select line coupled to the gate terminal of the second switch transistor are controlled by a common gate driver.

13. The pixel circuit as claimed in claim 10, wherein the controller is configured to program the pixel circuit with a recovery voltage so as to reverse bias the driving transistor according to the recovery voltage, the recovery voltage being based on the history of the pixel circuit's aging.

14. The pixel circuit as claimed in claim 13, wherein the controller is configured to calculate the recovery voltage according to an aging profile of the pixel circuit or retrieve the recovery voltage from a lookup table according to the aging profile.

15. The pixel circuit as claimed in claim 10, wherein the light emitting device comprises:

an organic light emitting diode.

16. A display system comprising:

a pixel array having a plurality of pixel circuits arranged in rows and columns, each pixel circuit including:

a light emitting device;

a driving transistor configured to drive the light emitting device, the driving transistor being coupled in series with the light emitting device between a first power supply line and a second power supply line;

a first switch transistor for providing a programming voltage to a gate terminal of the driving transistor, via a data line;

a storage capacitor for being charged according to the programming voltage;

a second switch transistor connected in parallel with the storage capacitor, for discharging the storage capacitor, during a relaxation cycle, the system further comprising:

a source driver for driving the data line for providing the programming voltage according to a programming data;

a gate driver for driving the first switch transistor and the second switch transistor of the pixel circuit; and a controller for operating the source driver, the gate driver, and the first and second power supply lines, such that:

during a first frame, the pixel is programmed with a first programming voltage different from an image programming voltage for a valid image, and at least one of the first and second power supply lines are set so that at least one of the driving transistor or the light emitting device is under a reverse bias; and during one or more stand by frames following the first frame, the at least one of the driving transistor or the light emitting device maintains the reverse bias while the display is turned off so as to recover the display aging.

17. The display system as claimed in claim 16, further comprising a switch circuit for selective coupling an output of the gate driver to the first switch transistor or the second switch transistor, wherein the switch circuit comprises:

a third switch transistor coupled to the output of the gate driver and the first select line, and having a gate terminal for receiving a first enable signal;

a fourth switch transistor coupled to the output of the gate driver and the second select line and having a gate terminal for receiving a second enable signal;

a fifth switch transistor coupled to the first select line and a power supply line, and having a gate terminal for receiving the second enable signal; and a sixth switch transistor coupled to the second select line and the power supply line, and having a gate terminal for receiving the first enable signal.

18. The display system as claimed in claim 16, wherein the display array is an AMOLED display.

19. The display system as claimed in claim 16, wherein the controller is further configured to program each pixel circuit in the plurality of pixel circuits with a recovery voltage for each pixel circuit so as to reverse bias the driving transistor in each pixel circuit according to the recovery voltage, wherein the recovery voltage for each pixel circuit is calculated according to the aging profile of each pixel circuit so as to reduce the differential aging of the pixel circuits in the plurality of pixel circuits.

20. The display system as claimed in claim 16, wherein the controller is further configured to:

program each pixel circuit with a programming voltage for a valid image, during a programming cycle;

drive each pixel to emit light via the light emitting device according to the programming voltage, during a driving cycle; and apply a voltage to the driving transistor in each pixel based on the magnitude of the programming voltage, such the driving transistor in each pixel circuit is reverse biased according to the stress condition of the pixel during the driving cycle.

21. A method for a display including a pixel circuit, the pixel circuit having a light emitting device, a driving transistor for driving the light emitting device, and a storage capacitor, the method comprising:

during a first cycle, implementing an image display operation including programming the pixel circuit for a valid image and driving the light emitting device to emit light according to the programming; and during a second cycle, implementing a recovery operation for recovering the display aging, the recovery operation including:

setting at least one of the first and second power supply lines to a predetermined voltage level; and programming the pixel circuit with a recovery voltage different from an image programming voltage for a valid image such that the driving transistor is reverse biased according to the recovery voltage, the recovery voltage being based on the pixel circuit's aging history.

22. The method as claimed in claim 21, wherein the pixel circuit comprises a switch transistor for the image display operation, the method further comprising:

selectively providing a select signal from a common gate driver to the switch transistor or the relaxation switch transistor.

23. The method as claimed in claim 21, further comprising:

during a third cycle, implementing a relaxation operation for reducing a stress on the pixel circuit, the relaxation operation including:

selecting a relaxation switch transistor coupled to the storage capacitor in parallel, the storage capacitor being coupled to the gate terminal of the driving transistor and a first terminal of the driving transistor.

* * * * *